US006905383B1

(12) United States Patent
Daggs

(10) Patent No.: US 6,905,383 B1
(45) Date of Patent: Jun. 14, 2005

(54) PERSONAL FLOATATION DEVICE

(76) Inventor: Wanda Kwiatkowski Daggs, 4202 Trace View Dr. #216, Winston-Salem, NC (US) 27106-3456

( * ) Notice: Subject to any disclaimer, the term of this patent is extended or adjusted under 35 U.S.C. 154(b) by 0 days.

(21) Appl. No.: 10/665,731

(22) Filed: Sep. 17, 2003

Related U.S. Application Data

(63) Continuation-in-part of application No. 10/171,202, filed on Aug. 26, 2002, now abandoned.

(51) Int. Cl.[7] ..... B63C 9/08

(52) U.S. Cl. ..... 441/118; 441/119

(58) Field of Search ..... 441/88, 102, 105–119; 2/463, 464

(56) References Cited

U.S. PATENT DOCUMENTS

| | | | | |
|---|---|---|---|---|
| 3,371,363 | A * | 3/1968 | Blanc, Jr. | 441/118 |
| 3,733,631 | A * | 5/1973 | Cohn | 441/113 |
| 3,956,786 | A * | 5/1976 | O'Link | 441/112 |
| 5,184,968 | A * | 2/1993 | Michalochick et al. | 4411/116 |

* cited by examiner

*Primary Examiner*—Sherman Basinger

(57) ABSTRACT

A personal floatation device 10 includes a buoyant foam member 20 enclosed within inner and outer layers 52, 54 of a garment 50. The foam member 20 can be cut as an initially flat member, which can then be folded to fit around and conform to the wearer's upper torso. The folded foam member 20 is held in a folded configuration by the multi-layer outer garment 50. The buoyant foam 20 bears against the wearer's upper body to hold the head above water. The buoyant foam includes segments 38, 40 fitting over the wearer's shoulders and wings 42, 44 extending beneath the wearer's arms. This personal floatation device 10 is especially suited for use by small children.

5 Claims, 6 Drawing Sheets

FIG 9
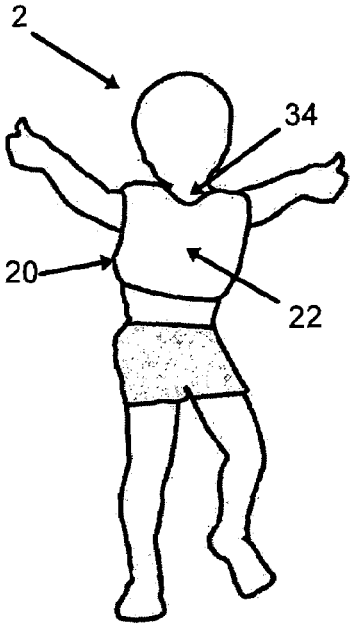
FIG 10
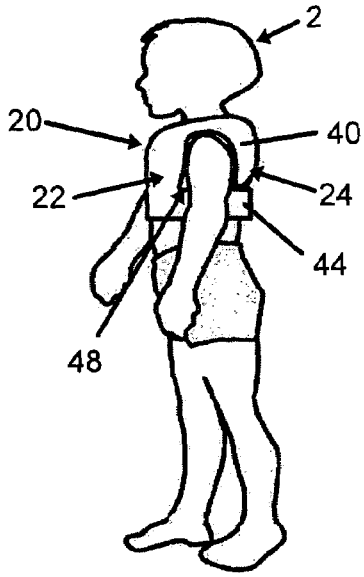
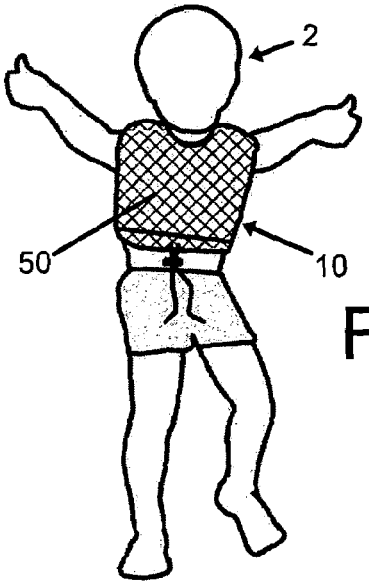
FIG 12
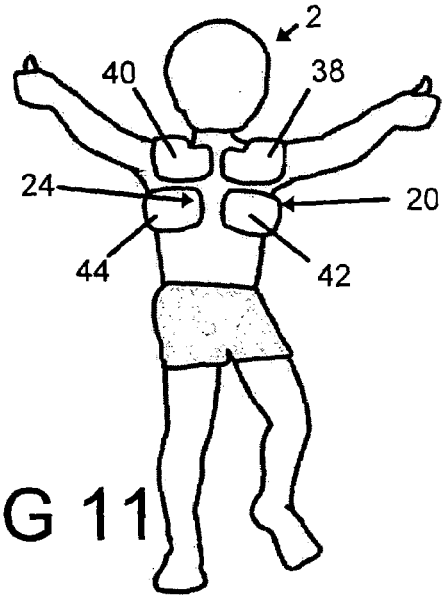
FIG 11

PERSONAL FLOATATION DEVICE

CROSS REFERENCE TO PRIOR CO-PENDING APPLICATION

This application is a continuation in part of prior application Ser. No. 10/171,202 filed Aug. 26, 2002 and abandoned upon the filing of this application.

BACKGROUND OF THE INVENTION

1. Field of the Invention

This invention relates to a personal floatation device, which can be worn as a garment by an individual, especially a child, in a manner which insures that the wearer's head will be maintained above water should the person enter water in circumstances where that person might be injured or drown.

2. Description of the Prior Art

U.S. Pat. No. 3,144,668 discloses a child's safety play suit including a single front two-ply panel and two rear two-ply panes form three respective compartments with three separate buoyant pads located in respective two-ply panels. Each buoyant pad comprises an envelope in turn containing a buoyant material mass. Therefore a number of pockets or compartments must be formed making this garment relatively labor intensive to fabricate. The buoyant panels also do not extend continuously beneath the armpits nor does a single buoyant panel extend over the occupant's shoulders and around the neck. This suit is also joined by snap fastener elements extending down the rear of the suit. This multi-segment configuration could allow the individual floatation foam panels to ride up in water so that the child's face may not be held above water. Buoyancy forces must therefore be transferred to the child's body through the fabric and not directly from the buoyant material to the body.

U.S. Pat. No. 5,184,968 does disclose a floatation device with a one-piece floatation member extending on both the front and rear of the occupant of the swimwear including the floatation member. The floatation member does not extend below the occupant's arms so the flotation member can ride up and will be restrained only by the fabric surrounding the floatation member. Reliance upon the fabric in this way will limit the flexibility of the fabric and can limit the size range of children or others who could wear a suit of this type. Greater stress is also place on the fabric and its seams or stitching, which would seem to limit the useful life of individual garments.

Front and rear floatation members in the device shown in U.S. Pat. No. 3,050,753 are joined only by straps extending over an infant's shoulders, and by straps extending along the child's sides. These straps would be even more likely to permit the floatation member to ride up and would offer less assurance that the child's head would be maintained above water.

U.S. Pat. No. 3,956,786 also employs multiple buoyant members, including front and rear hinged collar members as well as bib and back floatation elements extending below the collar and secured to the torso by a strap. These multiple sections can also shift relative to a child's body and it would appear that the hinged collar sections could press into the child's face or push the head forward into water.

None of these prior art floatation devices employ a single buoyant member which directly supports the wearer's upper torso to more reliably serve as a personal floatation device. These prior art devices either do not permit significant expansion of fabric surrounding the floatation members so that each garment can fit occupant's of different sizes, or they rely upon straps that can relax, come undone or uncomfortably bind the wearer so that they are uncomfortable.

SUMMARY OF THE INVENTION

A personal floatation device according to this invention includes a buoyant foam member. This buoyant foam member fits over a wearer's shoulders and beneath the wearer's arms to fit over the majority of the front and rear of the wearer's upper torso. The buoyant foam member directly supports the wearer's upper torso to maintain the wearer's head above water. This buoyant form member comprises a one-piece, initially flat, member folded to fit over the wearer's shoulders and around the wearer's sides beneath the wearer's arms. The buoyant foam member is constrained in a folded configuration to fit the wearer's upper torso, preferably by an outer fabric garment forming an enclosure in which the buoyant foam member is located.

This personal floatation device enhances the safety of one wearing the personal flotation device in water. The buoyant foam member of this personal floatation device is in the form of a one-piece vest, cut from a flat, flexible buoyant material. The one-piece vest, when in a flat configuration has a central trunk section with a generally curved opening above the trunk section and spaced from a top edge thereof. A slot extends from the generally curved opening to the top edge of the foam member to form opposed upper segments on opposite sides of the slot and the curved opening. The one-piece vest, when in the flat configuration, also includes protruding wings extending from opposite side edges of the trunk section adjacent its lower edge. The one-piece vest is folded about a generally horizontal axis to form the personal flotation device so that the upper segments extend behind and are spaced from the trunk section so that the generally curved opening will surround the neck of a wearer of the personal flotation device. The wings are folded about generally vertical axes to also extend behind and spaced from the trunk section with the wings and the upper segments forming arm passages through which the arms of the wearer can extend. The one piece vest being restrained in the folded configuration when worn so that the one-piece vest extends over the wearer's shoulders and under the wearer's armpits to support the wearer's torso.

The personal floatation device can comprise a buoyant shirt with inner and outer layers forming a shirt configuration with an enclosure between the inner and outer layers. An upper opening for a wearer's neck extends through both inner and outer layers. Two side openings, through which the wearer's arms can extend, are formed through the inner and outer layers on opposite sides of the upper opening. The buoyant material is confined within the enclosure between the inner and outer layers. This buoyant material extends between the upper openings and each side opening between a front portion of the enclosure to a rear portion of the shirt. The buoyant material also extends beneath both side openings between the front portion of the enclosure and the rear portion of the enclosure so that buoyant material would be located on both the front and rear of a wearer's torso. The buoyant material has a sufficient volume to hold the wearer's head above water.

A personal floatation device according to this invention provides a number of advantages. It will not come off during normal water activities, and does not interfere with arm and shoulder movement.

Unlike conventional floatation devices, such as water wings and life jackets, this personal floatation device can be worn as a garment and will not fall off or get knocked off during play.

A device of this type will provide confidence to non-swimmers and peace of mind to parents of small children around public and private pools and bodies of water.

This device will keep the head above water while allowing free arm movement, so that it can be used during swimming instruction.

The comfort afforded by this device and its similarity to a football jersey with shoulder pads will make it more attractive to young children who will be anxious to wear it as a fashion statement as well as for protection. This personal floatation device can be manufactured in a variety of printed fabrics including beach prints, sports prints and can employ a variety of advertising logos and symbols.

Although this device is especially suited for use by small children, it can be used by others, either as part of normal activity or in special circumstances. For example, a personal floatation device of this basic type can be used for rehabilitation to provide buoyancy during water therapy.

BRIEF DESCRIPTION OF THE DRAWINGS

FIG. 9 is a front view of a child showing the manner in which the foam material surrounds the upper torso of the child. The outer fabric layers are not shown in FIGS. 9–11.

FIG. 10 is a side view showing the manner in which the foam material drapes over a child's shoulders and in which the lower wings extend beneath the child's armpits.

FIG. 11 is a rear view showing the manner in which the upper segments and the lower wings fit on the back of a child.

FIG. 12 is a view on the same scale as FIGS. 9–11 showing the personal floatation device with the outer fabric layers enclosing the buoyant foam material.

DETAILED DESCRIPTION OF THE PREFERRED EMBODIMENT

Figure 1:
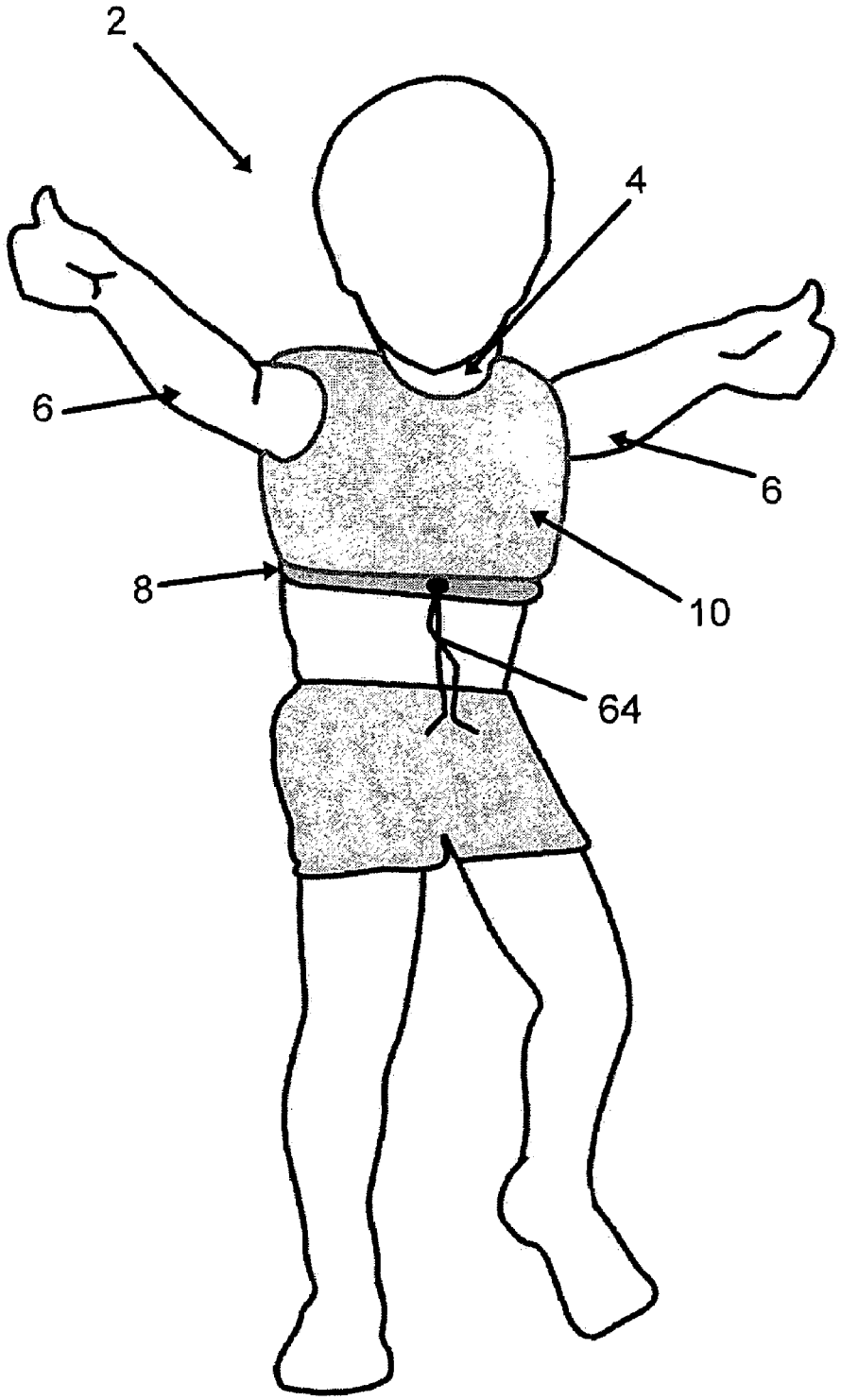
FIG. 1 is a view of an infant wearing a personal floatation device according to the invention.

The personal floatation device 10 according to the present invention comprises a fabric garment 50 in which a buoyant member 20 is encased. The personal floatation device 10 can be worn much like a Tee Shirt surrounding the upper torso 8 of the wearer 2 as shown in FIG. 1. Although not limited to use by a child or an infant, this device 10 is especially suited for use by children. In addition to surrounding the upper torso 8, the personal floatation device will also fit around the wearer's neck 4 and includes openings on the sides through which the child's arms 6 can extend. This device 10 fits so that the buoyancy imparted by buoyant member 20 will act to maintain the wearer's head above water. In the preferred embodiment, the buoyant material 20 comprises a foam member, which not only fits over the wearer's shoulders, but also fits below each arm 6. The foam or buoyant member 20 extends from a front portion 22 over the wearer's shoulders and under the wearer's arms so that a rear portion 22 is located along the wearer's back. Preferably the foam member 20 comprises a one-piece flat flexible foam member that is folded around the wearer's upper torso. The one-piece flat flexible foam member 20 thus is in the form of a one-piece vest, which fits around the wearer's upper torso 8 and directly supports the torso 8, especially beneath the arms 6. Since the foam material 20 fits around the torso and below the arms, the foam material will not ride up on the occupant.

Figure 2:
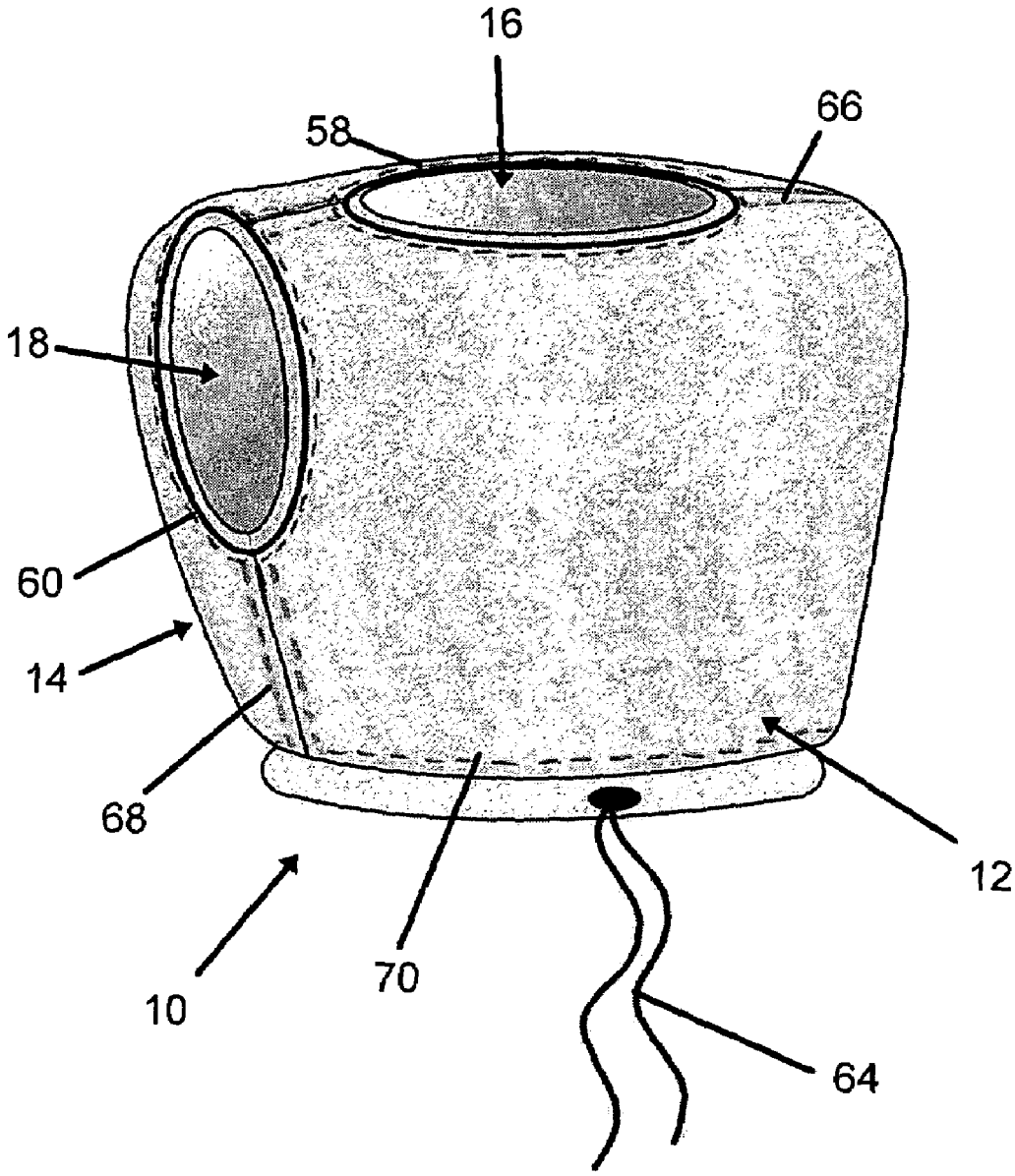
FIG. 2 is a three dimensional view of the personal floatation device shown in FIG. 1.

The personal floatation device 10 is in the form of a Tee Shirt like garment as shown in FIG. 2, which fits over the head of the wearer 2. In the preferred embodiment the flat flexible foam member 20 is encased between and inner fabric layer 52 and an outer fabric layer 54, which form the fabric garment 50. The combined device 10 thus functions as a buoyant shirt with a neck opening at the top and arm openings 18 on both sides. This buoyant shirt 10 has a shirt front portion 12 and a shirt rear portion 14, and it is this fabric garment 50 which holds the flat flexible foam member 20 in its folded configuration in which it forms a one piece buoyant vest 20. The inner fabric layer 52 and the outer fabric layer 54, each comprise separate sections which are sewn or stitched together, and are stitched to each other to confine and restrain the flexible vest or foam member 20 in a folded configuration. Although the flexible foam vest 20 is constrained in a folded configuration, the foam vest 20 can expand outwardly to fit the torso 8 of its wearer.

Figure 3:
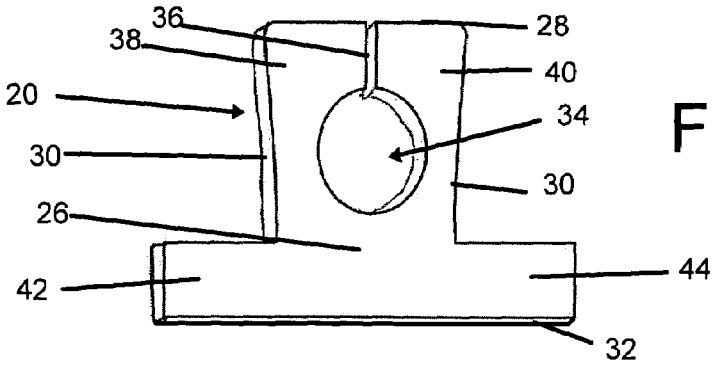
FIG. 3 is a three dimensional view of a flat piece of buoyant foam material used in the personal floatation device shown in FIGS. 1 and 2.
Figure 4:
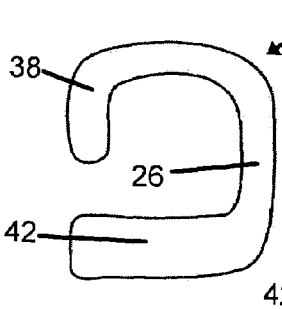
FIG. 4 is a side view showing how portions of the buoyant foam of FIG. 3 can be draped over the wearer's shoulders and around the wearer's sides.
Figure 5:
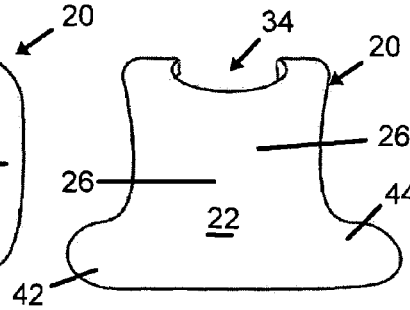
FIG. 5 is a front view of the folded foam material of FIG. 4.
Figure 6:
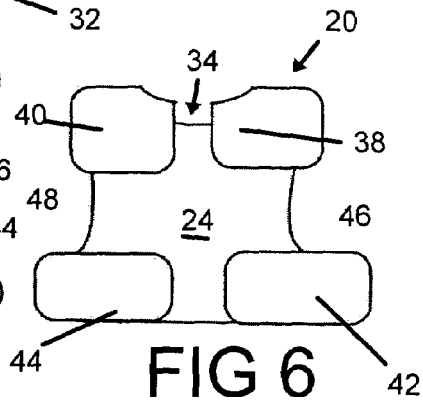
FIG. 6 is a rear view of the folded foam material of FIGS. 4 and 5.

FIGS. 3–7 show more details of the foam vest 20. As shown in FIG. 3, the foam vest 20 is formed from a single piece of initially flat foam material. In the preferred embodiment this flat foam piece has a thickness of approximately one and one-fourth (1¼) inch, or greater. The shape shown in FIG. 3 is die cut form a larger sheet or foam material. Since the foam material used in the personal floatation device 10 is a one-piece member, only a single die is needed to cut each unit resulting in manufacturing cost savings and design simplicity.

The flat foam piece 20 has a central trunk or bib section 26. A generally curved or circular upper opening 34 is die cut at the top of the central trunk section 26 and a slot 36 is die cut between the curved opening 34 and a top edge 28 to form two opposed upper segments 38, 40 protruding upwardly from the trunk section 26. The portion of the foam member 20 including the two upper segments and the curved opening 34 has a generally rectangular shape formed by top edge 28 and side edges 30. Two generally rectangular wings 42 and 44 extend from opposite sides of the central trunk section 26 and extend to the lower peripheral edge 32 of this one-piece foam member 20.

Figure 7:
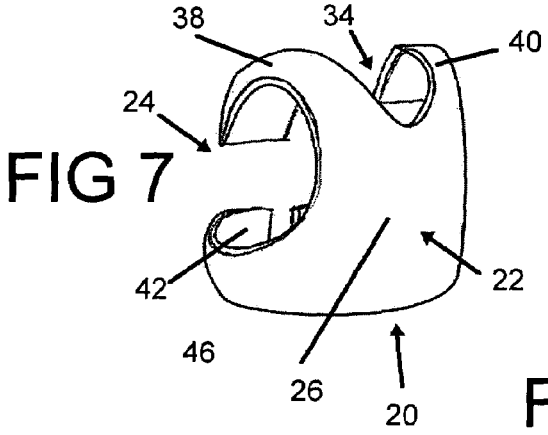
FIG. 7 is a three dimensional view of the folded foam material of FIGS. 4–6 showing openings for the wearer's neck and arms.
Figure 8:
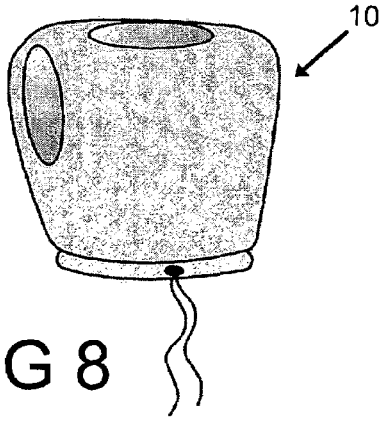
FIG. 8 is a three dimensional view of the personal floatation device on the same scale as FIG. 7 demonstrating how the foam material can be encased by outer fabric layers to form the personal floatation device.

Although the foam member 20 is die cut in a flat configuration, it is folded into a three dimensional vest shape, as best seen in FIG. 7, so that it will fit around the torso 8 of the wearer of the personal floatation device 10, with front portion 22 fitting on the wearer's chest and rear portion 24 fitting the wearer's back. The central trunk section 26 will form the majority of the front portion of the foam vest 20 and the upper segments 38, 40 and the lower wings 42, 44 will be folded around to extend into the rear portion 24 of the torso fitting vest 20. The upper segments 38, 40 will fold about a horizontal axis, when viewed in FIG. 7, as well as when worn, so that these upper segments will fit over the shoulders of the wearer. The portion of these upper segments 38, 40 which extend over the shoulders is not merely a strap section because the volume of the foam adds significant buoyancy and this portion of the foam material is especially useful in keeping the occupant's head above water. The curved opening 34 between the two upwardly protruding segments 38, 40 will form an opening surrounding the wearer's neck and providing space for the wearer's neck to fit through when the personal floatation device 10 is donned by the wearer. The wings 42 and 44 are folded toward the rear about parallel, generally vertical axes when viewed in FIG. 7, as well as when worn, so that the wings will extend around the sides of the wearer beneath the wearer's arms and behind the wearer's torso. The wings 42, 44 will be spaced from the upper segments 38, 40 on each side to form arm passages 46, 48 when the wearer dons the personal floatation device 10. The foam vest 20 will be constrained in this folded configuration by the fabric forming the exterior and interior of the personal floatation device 10 as can be seen by comparing FIG. 7 and FIG. 8. FIGS. 9–11 show the manner in which the flexible foam vest 20 fits around the torso of the wearer. The outer fabric, which constrains the flexible foam vest 20 in the folded configuration fitting the wearer's torso is not shown in FIGS. 9–11, but comparison of FIG. 11 with FIG. 12, in which the outer fabric garment 50 is shown, demonstrates how the foam material is constrained.

Figure 13:
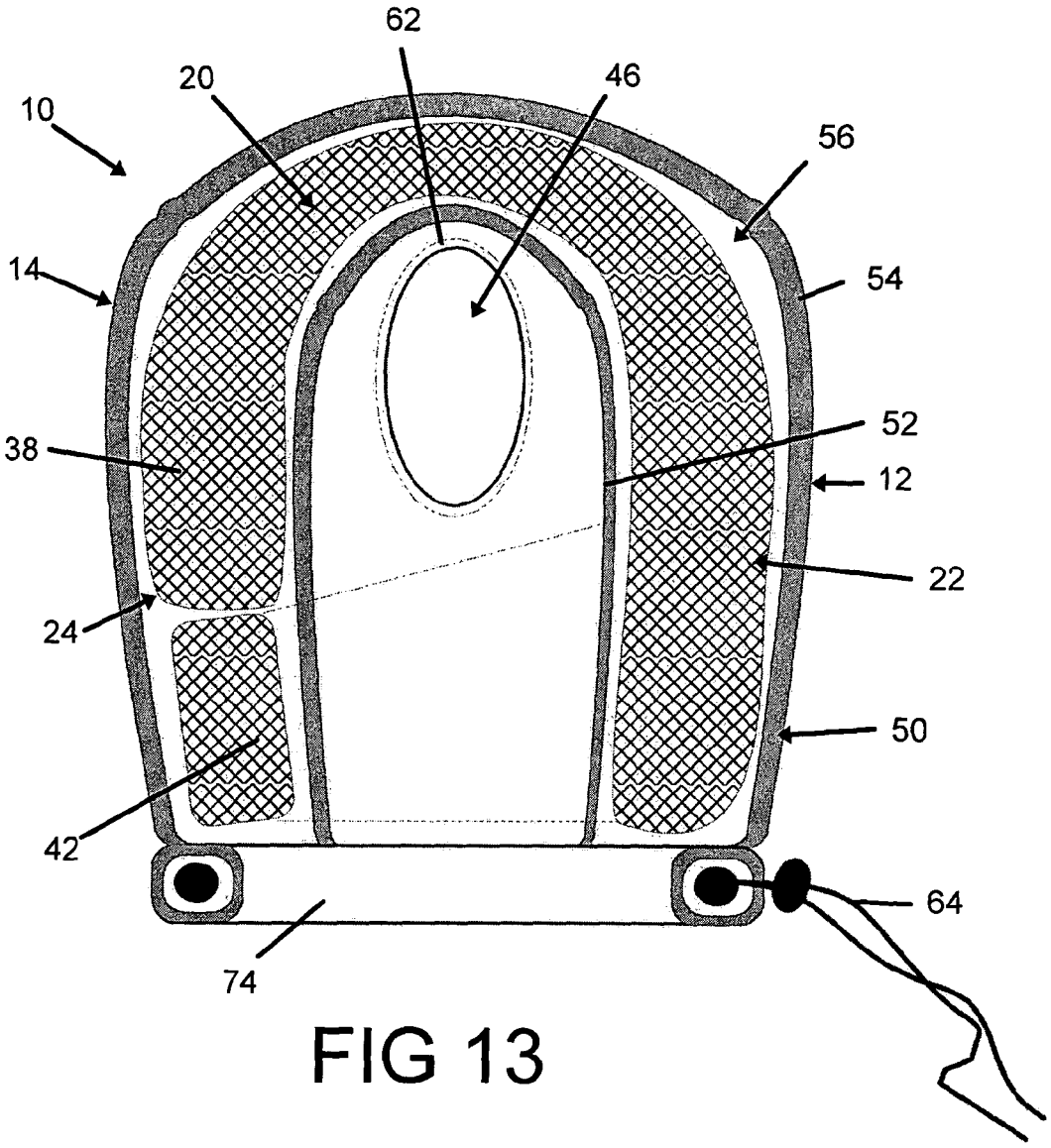
FIG. 13 is a side sectional vies showing the folded foam material constrained within an envelope formed by two fabric layers.
Figure 14:
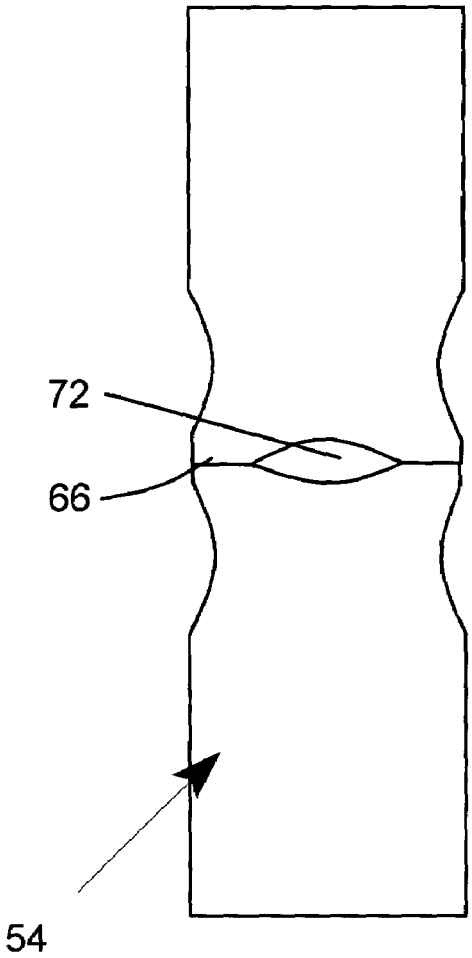
FIG. 14 is a view showing the outer fabric layer prior to assembly with the inner fabric layer to form the garment in which the buoyant foam material.
Figure 15:
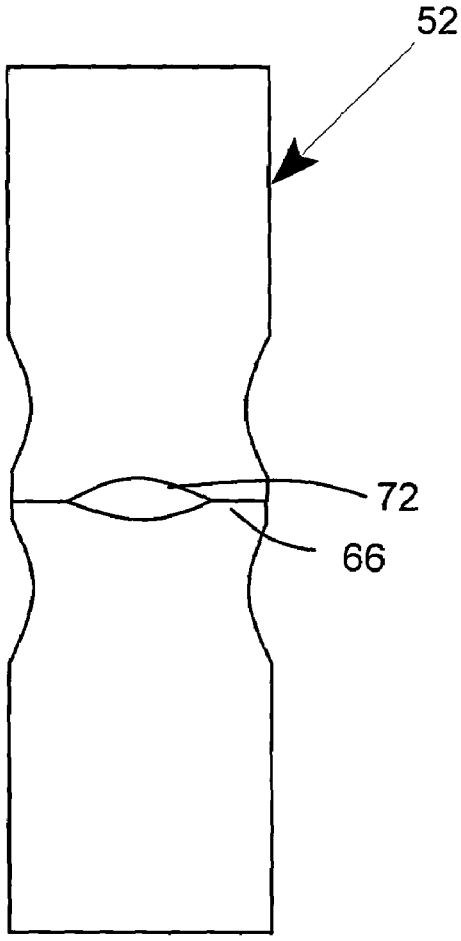
FIG. 15 is a view showing the inner fabric layer prior to assembly with the outer fabric layer to form the garment in which the buoyant material is constrained in its folded or overlapping configuration.

FIG. 13 is a side sectional view of the personal floatation device 10 showing the folded foam material 20 constrained within an enclosure 56 formed between an inner fabric layer 52 and an outer fabric layer 54. FIGS. 14 and 15 show the fabric pieces that are used to form the inner layer 52 and the outer layer 54. The outer layer 54 is shown as slightly larger than the inner layer 52, and each fabric layer is formed by two separate pieces of fabric which are stitched together along a shoulder line 66 flanking a crew neck opening 72. As also seen in FIG. 2, the inner fabric layer 52 is stitched to the outer fabric layer 54 along side stitches 68 and a bottom stitch 70. The layers are also stitched together to form a stitched neck border and stitched arm borders 60 and 62. A drawstring pocket 74, through which a drawstring 64 extends, can be sewn to the bottom edge to complete the two-ply or multiplayer garment 50.

The foam member 20 is not held tightly in the enclosure 56 formed between the inner fabric layer 52 and the outer fabric layer 54. The foam material 20 can shift within this enclosure to fit the occupant. For example, the free ends of both the upper segments 38, 40 and the wings 42, 44 can move toward and away from each other to accommodate the torso of the wearer, so that the same personal floatation device 10 can fit occupants of different sizes. The inner fabric layer 52 and the outer fabric layer 54 are preferably formed of an material, such as neoprene, UV-Flex, spandex, stretch jersey or some other material having a greater elasticity than natural textile fibers. Thus the fabric layers can expand and the foam vest member can shift to fit individuals of larger size, and the same garment can, within limits, be worn as a child grows. This expansion is possible because the fabric layers do not hold the buoyant foam material 20 to the occupant's body. Instead the buoyant foam material 20 fits around the upper torso, especially under the arms so that the foam material bears against a large surface area of the torso, even though it is separated from intimate contact with the body by the inner fabric layer 52. Since the foam 20 conforms to the body in this manner, it more evenly supports the body in water and can be a more comfortable garment, which will not tend to cut into the occupants skin.

The representative embodiment depicted herein is not the only device, which can employ the principles embodied by this invention. Modifications apparent to those of ordinary skill in the art can be for any number of reasons. For example, straps extending between the wearer's legs could be added to the bottom of this personal floatation device. Means other than an outer garment for holding the foam material in the folded configuration could also be employed. For example the form material could be constrained only on the rear. Therefore the invention is not limited to the single embodiment depicted herein, but is defined by the following claims.

I claim:

1. A personal flotation device for enhancing the safety of one wearing the personal flotation device in water, the device comprising:

a one-piece vest, cut from a flat, flexible buoyant material, the one-piece vest, when in a flat configuration having a central trunk section with a generally curved opening above the trunk section and spaced from a top edge thereof with a slot extending from the generally curved opening to the top edge thereof to form opposed upper segments on opposite sides of the slot and the curved opening, the one-piece vest, when in the flat configuration, also including wings extending from opposite side edges of a trunk section adjacent the lower edge thereof, the one-piece vest being folded about a generally horizontal axis to form the personal flotation device so that the upper segments extend behind and are spaced from the trunk section so that the generally curved opening will surround the neck of a wearer of the personal flotation device, and with the wings being folded about generally vertical axes to also extend behind and spaced from the trunk section with the wings and the upper segments forming arm passages through which the arms of the wearer can extend, the one piece vest being restrained in the folded configuration when worn so that the one piece vest extends over the wearer's shoulders and under the wearer's armpits to support the wearer's torso.

2. The personal floatation device of claim 1 wherein the one-piece vest is disposed between inner and outer layers.

3. The personal floatation device of claim 2 wherein the inner and outer layers comprise fabric layers joined around the generally curved opening forming a neck opening and around openings along opposite sides to form arm openings.

4. The personal floatation device of claim 2 wherein the wings are free to laterally shift between the inner and outer layers so that the personal floatation device can fit wearers of different sizes.

5. The personal floatation device of claim 1 wherein the one-piece vest comprises a die cut member.

* * * * *